US007422006B2

(12) United States Patent
Noller et al.

(10) Patent No.: US 7,422,006 B2
(45) Date of Patent: Sep. 9, 2008

(54) FUEL INJECTOR

(75) Inventors: Klaus Noller, Oppenweiler (DE); Peter Land, Pettstadt (DE); Christof Vogel, Bischberg (DE); Michael Huebel, Gerlingen (DE); Thomas Gerschwitz, Eberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/581,160

(22) PCT Filed: Oct. 29, 2004

(86) PCT No.: PCT/EP2004/052727

§ 371 (c)(1),
(2), (4) Date: Apr. 13, 2007

(87) PCT Pub. No.: WO2005/054662

PCT Pub. Date: Jun. 16, 2005

(65) Prior Publication Data

US 2007/0246017 A1 Oct. 25, 2007

(30) Foreign Application Priority Data

Dec. 8, 2003 (DE) ..... 103 57 189

(51) Int. Cl.
*F02M 37/04* (2006.01)
*F02M 37/08* (2006.01)

(52) U.S. Cl. ..... 123/498; 123/446

(58) Field of Classification Search ..... 123/498, 123/467, 504, 472, 478, 446; 239/533.8, 239/533.9, 533.12, 533.1, 533.2, 102.2, 102.1, 239/585.1
See application file for complete search history.

(56) References Cited

U.S. PATENT DOCUMENTS

| | | | | |
|---|---|---|---|---|
| 4,858,439 | A | 8/1989 | Sawada et al. | |
| 7,040,550 | B2 * | 5/2006 | Hohl et al. | 239/102.2 |
| 7,083,114 | B2 * | 8/2006 | Maeurer et al. | 239/102.2 |
| 7,267,111 | B2 * | 9/2007 | Liskow | 123/498 |
| 2004/0118950 | A1 * | 6/2004 | Hohl et al. | 239/584 |
| 2004/0164175 | A1 * | 8/2004 | Maeurer et al. | 239/102.2 |
| 2004/0237519 | A1 * | 12/2004 | Schurz | 60/553 |
| 2005/0247803 | A1 * | 11/2005 | Liskow | 239/102.2 |
| 2006/0043213 | A1 * | 3/2006 | Gerschwitz et al. | 239/102.2 |
| 2006/0175438 | A1 * | 8/2006 | Stier | 239/584 |
| 2006/0289682 | A1 * | 12/2006 | Kammerer et al. | 239/533.8 |
| 2007/0246017 | A1 * | 10/2007 | Noller et al. | 123/472 |

FOREIGN PATENT DOCUMENTS

| | | |
|---|---|---|
| DE | 197 08 304 | 9/1998 |
| DE | 199 62 177 | 7/2001 |
| DE | 101 62 045 | 6/2003 |
| EP | 0 477 400 | 9/1990 |
| WO | WO 03/031799 | 4/2003 |
| WO | WO 2004/076845 | 9/2004 |

* cited by examiner

*Primary Examiner*—Mahmoud Gimie
(74) *Attorney, Agent, or Firm*—Kenyon & Kenyon LLP

(57) ABSTRACT

A fuel injector has a piezoelectric or magnetostrictive actuator, which actuates a valve-closure member cooperating with a valve-seat surface to form a sealing seat. A hydraulic coupler includes a master piston, a slave piston, and a coupler volumeformed in-between. The master piston and the slave piston are axially displaceable with respect to one another. The coupler volume is connected to a compensating chamber via a throttle. A flexible section delimits the compensating chamber at least partially, and the coupler volume, the throttle, and the compensating chamber are filled with a hydraulic medium. At least one spring element directly or indirectly exerts pressure on the flexible section from the outside, via fixed components.

21 Claims, 4 Drawing Sheets

FUEL INJECTOR

FIELD OF THE INVENTION

The present invention relates to a fuel injector having a piezoelectric or magnetostrictive actuator.

BACKGROUND INFORMATION

A system for an adaptive, mechanical tolerance compensation acting in the lift direction for a path transducer of a piezoelectric actuator for a fuel injector is described in published European Patent document EP 0 477 400. In the process, the actuator lift is transmitted via a hydraulic chamber. The hydraulic chamber has a defined leak having a defined leakage rate. The actuator lift is introduced into the hydraulic chamber via a master piston and transmitted to an element to be driven via a slave piston, for example, a valve needle of a fuel injector.

Guided in the master piston is a slave piston, which also seals the master piston and in this way forms the hydraulic chamber. Arranged in the hydraulic chamber is a spring which presses the master piston and the slave piston apart. When the actuator transmits a lifting movement to the master cylinder, the pressure of a hydraulic fluid in the hydraulic chamber transmits this lifting movement to the slave piston since the hydraulic fluid in the hydraulic chamber is not compressible and only a small portion of the hydraulic fluid is able to escape through the ring gap during the short duration of a lift. In the rest phase, when the actuator exerts no pressure force on the master cylinder, the spring pushes the slave piston out of the cylinder and, due to the generated vacuum pressure, the hydraulic fluid penetrates the hydraulic chamber and replenishes it via the annular gap. In this way, the hydraulic coupler automatically adapts to linear deformations and pressure-related expansions of a fuel injector. The hydraulic medium is sealed via sealing rings.

In addition, fuel injectors are known from the related art, which seal hydraulic media by flexible sections in the shape of a corrugated tube or convoluted bellows, for example, and preload the hydraulic medium by an elastic design of the flexible section.

Disadvantageous in this known related art is that the preloading by the flexible section changes during the service life of the fuel injector in a disadvantageous manner, the coupler has a complex design and is able to be produced only at great expense due to the many individual components of the coupler.

SUMMARY

The fuel injector according to the present invention has the advantage over the related art that the internal pressures of the coupler are able to be achieved in a permanent and reliable manner in different loading states of the coupler, the coupler is able to be produced in a simple and cost-effective manner, has a less complex design and is reliable in continuous operation.

In a first example embodiment, the flexible section has an axial section that extends axially with respect to the axis of movement of the pistons, and a radial section that extends radially with respect to the axis of movement of the pistons. This allows an advantageous integration of the flexible section in the coupler, so that the mechanical loading is minimized and the assembly facilitated. This is also achieved by giving the flexible section a sleeve-type and/or disk-type design.

In an advantageous manner, the flexible section is elastic and made from an elastomer, for example. This allows stretching of the flexible section and ensures that it continues to provide sealing with respect to conventional fuels.

Furthermore, it is advantageous if the spring element has a helical form. In this way, the spring element is able to be produced in a cost-effective manner and be integrated into the coupler in an especially simple and space-saving manner.

It is also advantageous if the spring element is braced on the master piston, in particular via a sleeve-shaped holder which is rigidly connected to the master piston and/or acts on the flexible section via an intermediate ring. In this way the coupler is able to have an advantageously simple design, and the pressure profile inside the coupler is able to be influenced further in that, given an enlargement of the coupler volume, the spring element is additionally tensioned by the relative movement of the two pistons.

In an example embodiment, the spring element is braced on the slave piston, e.g., on a flange that is rigidly connected to the slave piston and situated in the region of the end of the end of the slave piston facing away from the coupler volume, and/or the spring element acts on the flexible section via a sleeve ring, which has a disk-shaped radial extension and a sleeve-type axial extension on the outside. In this way the coupler is able to have an advantageously simple design, and the pressure profile inside the coupler is able to be influenced in addition in that, given an enlargement of the coupler volume, the spring element is relaxed by the relative movement of the two pistons.

Since the spring element has an annular design the size and the production expense can be reduced even further. Open and mutually overlapping ends allow a particularly simple and installation-facilitating design of the annular spring element. Rounding of the ends of the annular spring element avoids mechanical stressing of the flexible section, e.g., during installation.

If the spring element exerts no pressure on the flexible section in the unloaded state of the coupler, the flexible section is likewise able to be spared stressing.

If the throttle includes a throttling ball that is guided by a throttling gap in an opening, the throttle may have an especially simple design, and if the throttling ball is braced on a surface of the master piston delimiting the coupler volume, it may be utilized for the operation of the coupler in an advantageous manner.

DETAILED DESCRIPTION

Figure 1:
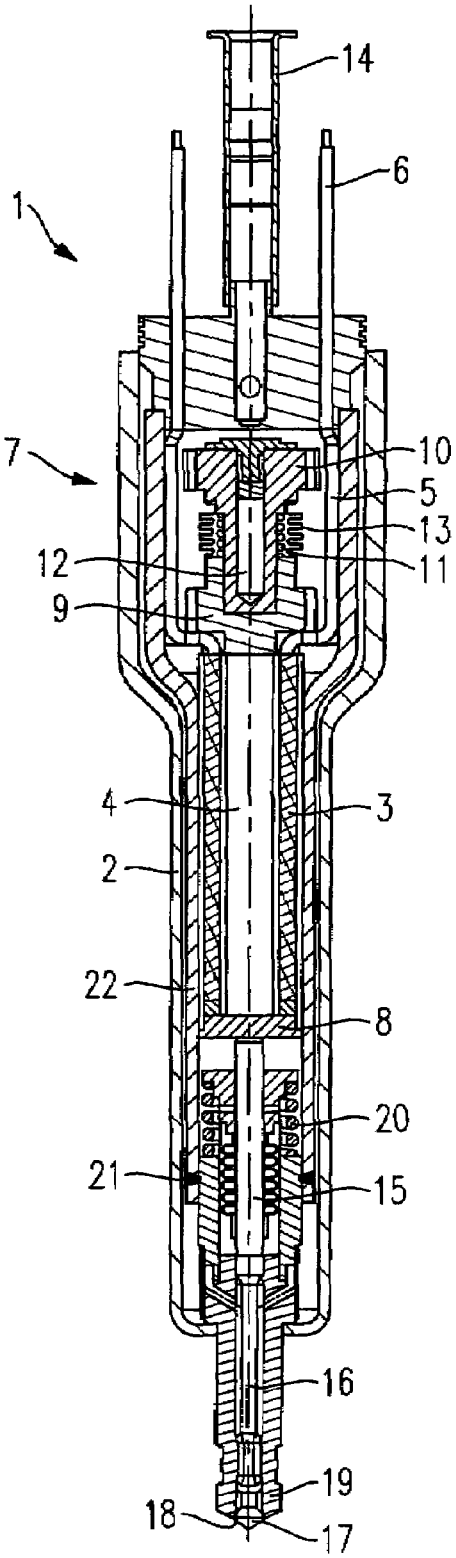
Fig. 1 (PRIOR ART)
FIG. 1 shows a schematic sectional view through a fuel injector according to the prior art.
Figure 2:
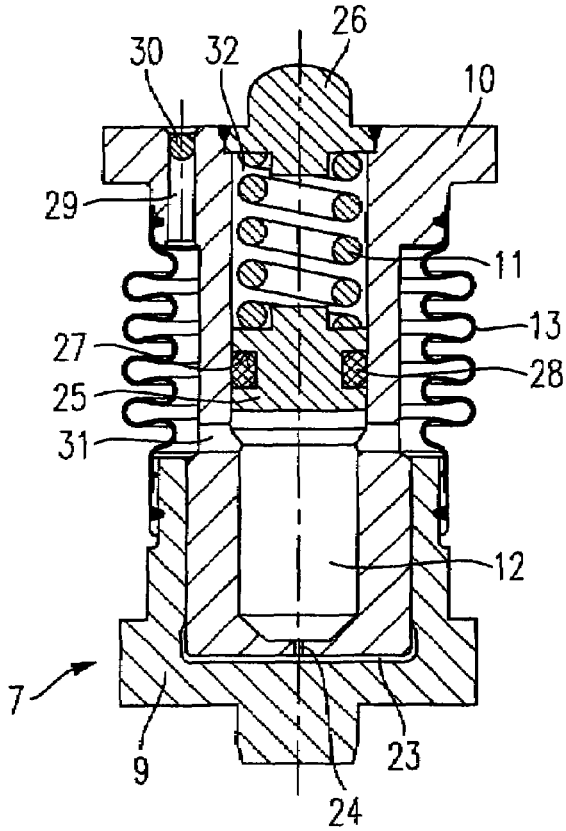
Fig. 2 (PRIOR ART)
FIG. 2 shows a schematic sectional view of portion of a fuel injector according to the prior art, in the region of the coupler, similar to the fuel injector shown in FIG. 1.

Before the present invention is described in greater detail with the aid of example embodiments, the essential components of a fuel injector according to the related art shall be briefly explained in FIGS. 1 and 2 for better understanding of the present invention. Identical parts have been provided with matching reference numerals in the figures.

Fuel injector 1 shown in FIG. 1 is configured as a fuel injector for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 includes a housing 2 in which a piezoelectric or magnetostrictive actuator 4 provided with an actuator extrusion coat 3 is situated. An electrical voltage is able to be supplied to actuator 4 via an electrical line 5 on which an electrical connector 6, which projects beyond housing 2, may be formed. On the intake side, actuator 4 rests against a master piston 9 of a hydraulic coupler 7, and on the discharge side it rests against an actuator head 8. Hydraulic coupler 7 also includes a slave piston 10, a compression spring 11 which applies an initial stress to hydraulic coupler 7, and a compensating chamber 12, which is filled with an hydraulic medium. The fuel is centrally supplied via an intake 14.

A detailed description of coupler 7 and its operation can be gathered from the description in connection with FIG. 2.

Disposed on the discharge side of actuator head 8 is an actuating element 15 that acts on a valve needle 16. Valve needle 16 has a valve-closure member 17 at its discharge-side end. Valve-closure member 17 cooperates with a valve-seat surface 18 formed on a nozzle body 19 to form a sealing seat. A restoring spring 20 acts on valve needle 16, in such a way that fuel injector 1 remains in the closed state in the non-energized state of actuator 4. It also resets valve needle 16 after the injection phase.

A welding seam 21 fixes nozzle body 19 in place inside an inner housing 22 that seals actuator 4 from the fuel. Fuel flows from intake 14 between housing 2 and inner housing 22 to the sealing seat.

FIG. 2 shows a detailed view of a coupler 7 whose design is similar to that of coupler 7 shown in FIG. 1.

Hydraulic couplers 7 in fuel injectors 1 are usually designed to implement or translate the lift of actuator 4 to valve needle 16 on the one hand, and/or to compensate for temperature-related linear changes in actuator 4 and housing 2 on the other hand. As shown in the exemplary embodiment, the latter is realized with the aid of coupler 7, which is designed as secondary-medium coupler and contains a hydraulic medium that does not come into contact with the fuel.

The hydraulic medium fills compensating chamber 12 and a coupler volume 23 formed between master piston 9 and slave piston 10, the coupler volume being connected to compensating chamber 12 via a throttle 24. Compensating chamber 12 is situated inside and outside slave piston 10, the two parts being interconnected by a transverse bore 31 and the outside-lying part of compensating chamber 12 being sealed from the fuel that flows through fuel injector 1 by a flexible section 13 designed as a corrugated tube.

In response to changes in the temperature, the hydraulic medium is exchanged between coupler volume 23 a d compensating chamber 12 via throttle 24. The required charging pressure is generated by compression spring 11 situated inside slave piston 10 in a pressure reservoir 32. Compression spring 11 is located between a first closure member 25 and a second closure member 26, the former having a groove 27 with a sealing ring 28 disposed therein to seal compensating chamber 12.

The filling of coupler 7 with hydraulic medium, for instance during production, is implemented via a channel 29, which may be sealed by a pressed-in closure ball 30, for example.

Figure 3:
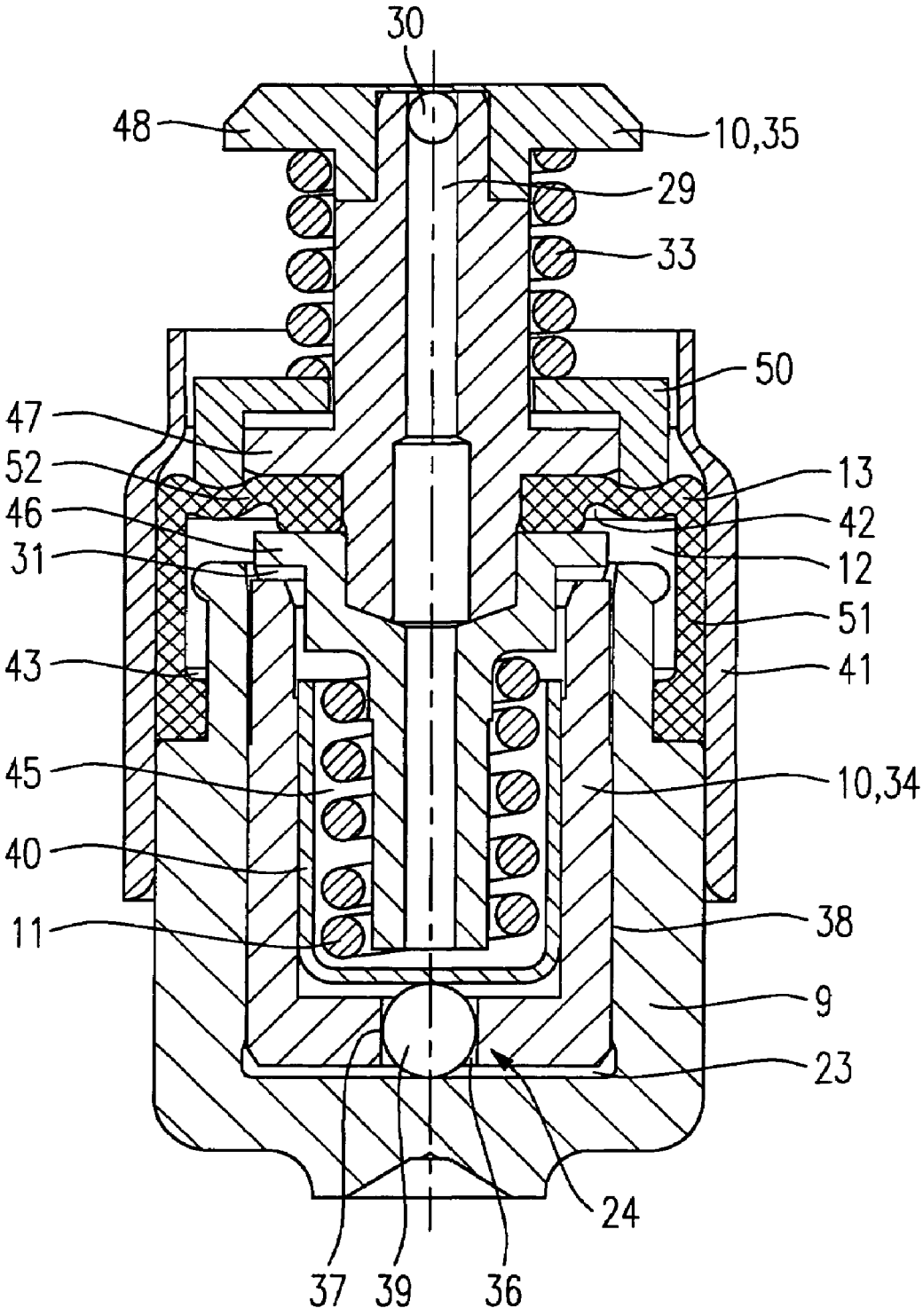
FIG. 3 shows a first exemplary embodiment of a fuel injector configured according to the present invention, in the region of the coupler.

FIG. 3 shows a first exemplary embodiment of a coupler 7 for a fuel injector 1 configured according to the present invention. Via a cup-shaped first slave section 34, slave piston 10 engages with hollow-cylindrical master piston 9 sealed on one side. Slave piston 10 or first slave section 34 is guided inside master piston 9 in an axially displaceable manner by a guidance gap 38. Guidance gap 38 is relatively small, and the quantity of hydraulic medium flowing through guidance gap 38 is very small. In other exemplary embodiments guidance gap 38 may have a throttle function.

In this exemplary embodiment, slave piston 10 is made up of first slave section 34 and a second slave section 35. By its sealed end, first slave section 34 delimits coupler volume 23 together with the base of master piston 9, throttle 24 being centrally disposed in the sealed end of first slave section 34. Throttle 24 is made up of an opening 36, which is situated in the center of the base of cup-shaped first slave section 34, and a throttling ball 39 which is guided therein by a throttling gap 37.

The open end, facing away from coupler volume 23, of first slave section 34 is sealed by second slave section 35. Second slave section 35 partially engages with first slave section 34, tapers in the process and, in the upper region of first slave section 34, is joined thereto by pressing or welding, for example, so as to be immovable. Between throttling ball 39 and the end of second slave section 35 engaging with first slave section 34 is compression spring 11, which is preloaded and situated in a spring chamber 45 located in first slave section 34, the tapering portion of second slave section 35 partially engaging with helical compression spring 11.

Compression spring 11 exerts pressure on throttling ball 39, a cup-shaped intermediate element 40 being interposed, and throttling ball 39 is braced on the base of master piston 9 in coupler volume 23. Intermediate element 40 may have bore holes (not shown) for the conveying of fuel. The upper ends, facing away from coupler volume 23, of first slave section 34 and slave piston 9 are situated at about the same level. In the axial extension of second slave section 35 pointing away from coupler volume 23, i.e., pointing up, second slave section 35 first has a first flange 46 followed by a second flange 47 and, at the upper end, a third flange 48.

All three flanges 46, 47 and 48 have approximately the same diameter. Second slave section 35 consists of two parts; first flange 46 is situated on the lower, and second and third flanges 47, 48 are situated on the upper part. Both parts are interconnected in an immovable manner. In this exemplary embodiment, the lower side, facing first slave section 34, of first flange 46 rests on the upper end of first slave section 34. First flange 46 has approximately the same diameter as first slave section 34.

Compensating chamber 12 is delimited by flexible section 13, second slave section 35 with its first flange 46 and master piston 9, compensating chamber 12 being connected to throttle 24 via transverse bore 31 and spring chamber 45. Transverse bore 31 is situated between first flange 46 and first slave section 34. Channel 29 with closure ball 30 is realized coaxially in second slave section 35, by a bore hole, which discharges into spring chamber 45.

Flexible section 13 is elastic and made of an elastomeric material, for instance, or steel. In this exemplary embodiment, flexible section 13 is subdivided into an axial section 51 which extends axially with respect to the travel direction of slave piston 10, and a radial section 52 which extends radially with respect to the travel direction of slave piston 10. Flexible section 13, which thus has the form of a disk or sleeve, has enlarged ends and is situated coaxially with respect to pistons 9, 10.

With the aid of friction-locking by pressure, for instance, the upper end, or the region of the inner circumference of the disk-shaped region of flexible section 13 lies in a first recess 42, which has the shape of a trough and annular groove and formed between first flange 46 and second flange 47. Via its lower end, flexible section 13 lies in a second recess 43, which has the shape of a trough and annular groove and is located on the outer surface, in the region of the upper end of master piston 9. The axial extension of second recess 43 is slightly greater than the axial extension of the lower enlarged end of flexible section 13. This facilitates the installation, in particular.

A sleeve-shaped holder 41 precisely encloses the upper half of master piston 9 and a portion of the upper part of second slave section 35 projecting beyond first slave section 34. Holder 41 is joined to master piston 9 in an immoveable manner, for instance in integral fashion and/or by friction-locking, using welding and/or pressing. Holder 41 tapers above flexible section 13. In this exemplary embodiment, axial section 51 of flexible section 13 is braced on holder 41 in an axially outward direction, so that holder 41 delimits the radial movement of axial section 51 toward the outside.

A spring element 33, which is situated between second flange 47 and third flange 48, is braced on third flange 48 and exerts pressure on flexible section 13 or axial section 51 from the outside, via a sleeve ring 50, which has the form of a perforated disk or sleeve and radially encloses second flange 47 by its sleeve-shaped section. Sleeve ring 50 has a form that is similar to that of flexible section 13, and its surfaces contacting flexible section 13 are rounded.

Forces that act on coupler 7 in the axial direction for long periods of time such as they occur, for example, in a temperature-related expansion of actuator 4, cause coupler volume 23 to shrink in size due to the draining of hydraulic medium from coupler volume 23 through throttle 24 via spring chamber 45 and transverse bore 31, into compensating chamber 12, which is partially delimited by elastic and diaphragm-like flexible section 13.

Due to preloading of compression spring 11, pressure, which enlarges coupler volume 23, is exerted on the hydraulic medium, so that, given a coupler 7 that is free of external loading, compression spring 11 enlarges coupler volume 23 to a maximum value, which is restricted, for instance, in that intermediate element 40 presses throttling ball 39 in a downward direction and sets down on the bottom of first slave section 34. Spring element 33 is dimensioned such that, for example, it exerts no pressure on flexible section 13 when coupler volume 23 is at a maximum, so that sleeve ring 50 rests on axial section 51 virtually without pressure, and spring element 33 is not tensioned.

The dynamic rigidity of coupler 7 is defined by the size and shape of throttling gap 37, in particular, and possibly by the size and shape of guidance gap 38.

Figure 4:
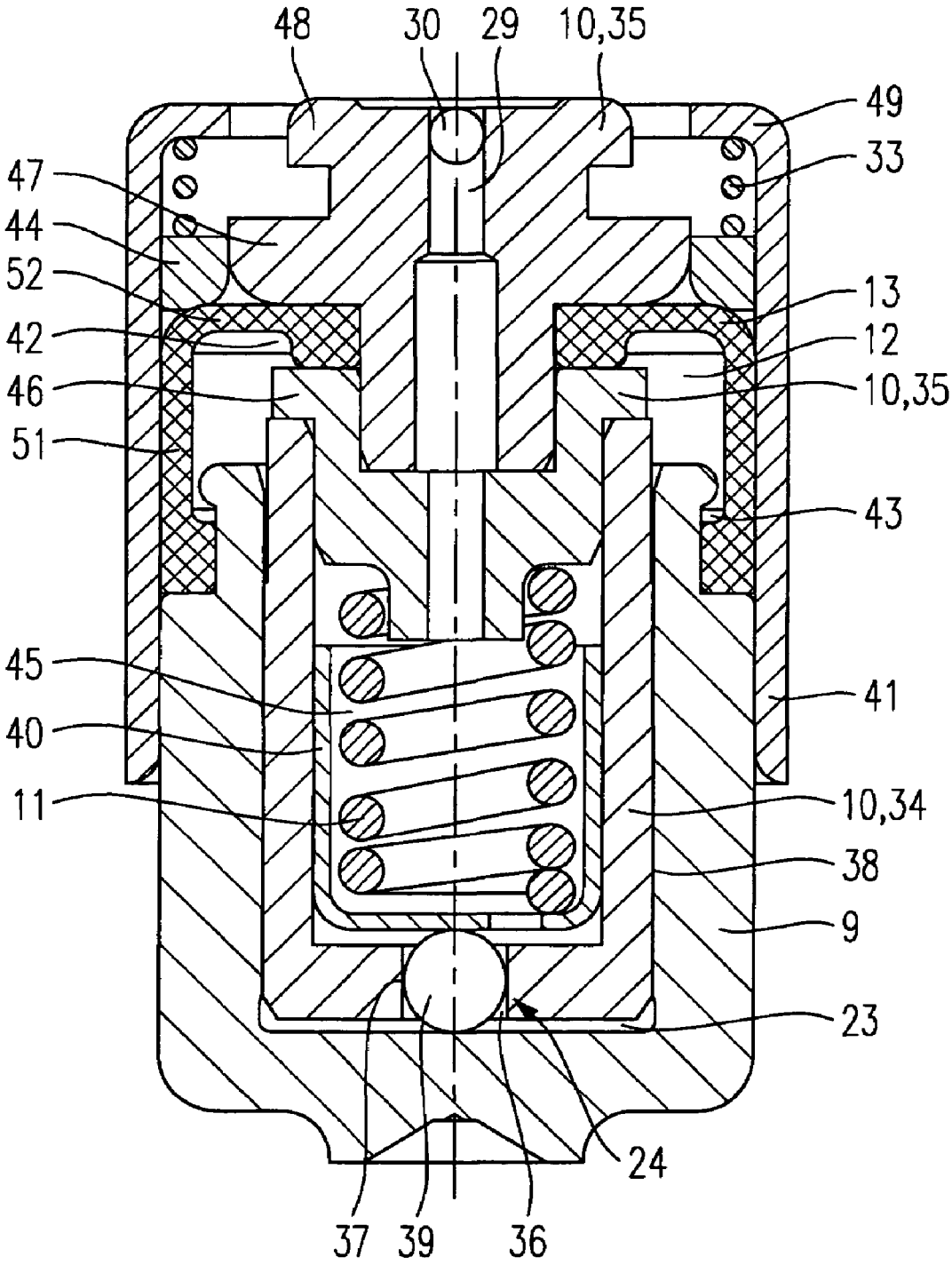
FIG. 4 shows a second exemplary embodiment of a fuel injector configured according to the present invention, in the region of the coupler.

FIG. 4 shows a second exemplary embodiment of a fuel injector configured according to the present invention, in the region of coupler 7, similar to first exemplary embodiment of FIG. 3. In contrast to the first exemplary embodiment of FIG. 3, spring element 33 is braced on a retracted region 49 situated immovably on holder 41, and on the other side presses on flexible section 13 via an intermediate ring 44. In this exemplary embodiment, the rounded surfaces of intermediate ring 44 exert pressure on the transition between axial section 51 and radial section 52.

Holder 41 extends without tapering from the outer surface of master piston 9 to the level of the upper end of slave piston 10, i.e., second slave section 34 or third flange 48, where it tapers in the radial direction as retracted region 49. Intermediate ring 44 is guided inside sleeve-shaped holder 41 in an axially movable manner, approximately at the level of second flange 47. Second flange 47 has a diameter that projects beyond first and third flanges 46, 48, respectively, so that only little radial play exits between second flange 47 and intermediate ring 44. Transverse bore 31 is not shown.

Figure 5:
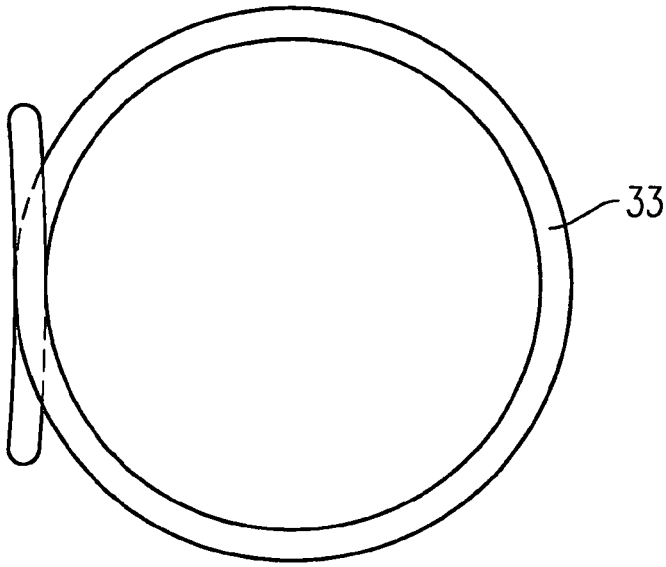
FIG. 5 shows an exemplary embodiment of the annular spring element.
Figure 6:
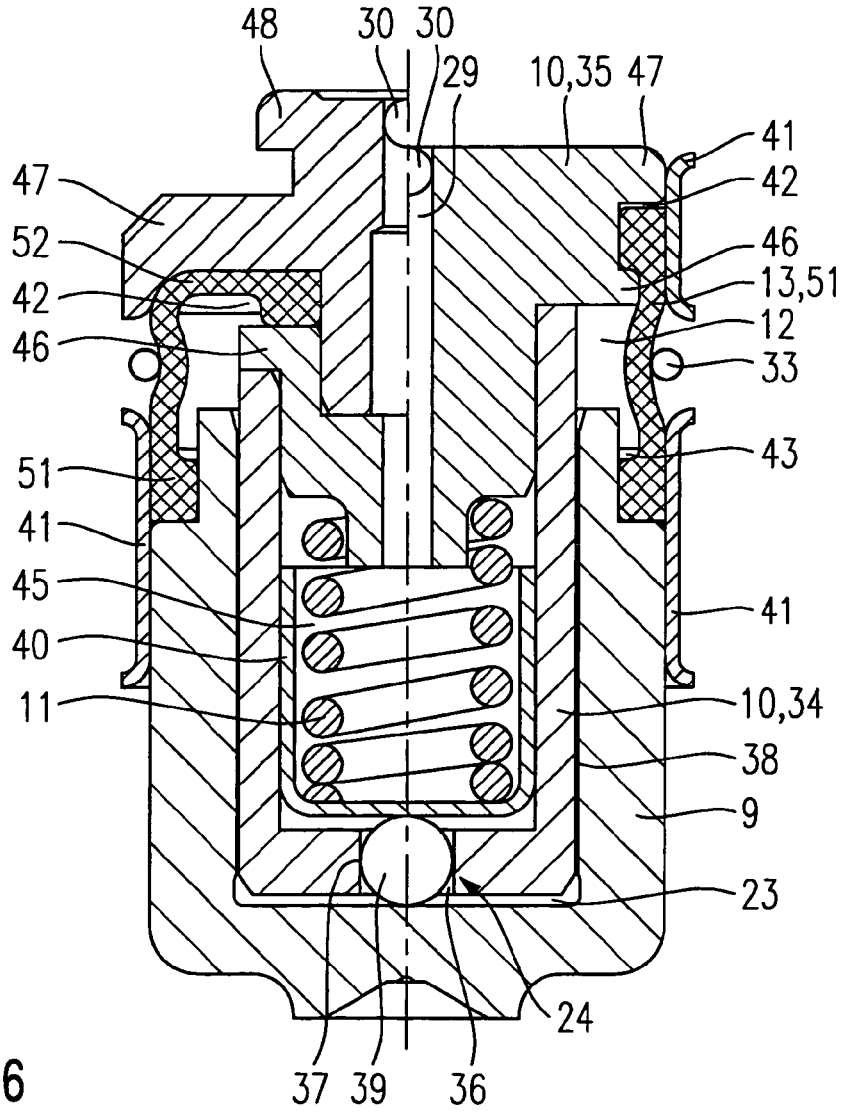
FIG. 6 shows a third and a fourth exemplary embodiment of the coupler of the fuel injector according to the present invention.

FIG. 5 shows an exemplary embodiment of an annular spring element 33, as it is used in the third and fourth exemplary embodiments in FIG. 6. Spring element 33 is made of spring steel and has and annular shape. The annular shape has two ends, i.e., it is not closed, the regions of the ends overlapping and extending tangentially toward the outside beginning with the region where the ends cross or overlap.

FIG. 6 shows a third and fourth exemplary embodiment of coupler 7 of fuel injector 1 according to the present invention. The third exemplary embodiment, which is shown on the left, has a design that is similar to the first and second exemplary embodiments according to the present invention. However, spring element 33 is annular, as shown in FIG. 5, and extends around axial section 51 of flexible section 13. The third exemplary embodiment shows coupler 7 in the unloaded state. In the unloaded state of coupler 7, spring element 33 presses on axial section 51 with prestressing, so that axial section 51 is slightly bent inward in the region of the location where spring element 33 is sitting and thereby reduces the size of compensating chamber 12.

In other exemplary embodiments, axial section 51 may also be plastically premolded in the form just described, spring element 33 resting in the plastically depressed form virtually without pressure, and tensioning of spring element 33 coming about only when pressure is applied from the inside by the hydraulic medium, in axial loading of coupler 7. Due to the coating of spring element 33 and/or flexible section 13 or axial section 51, friction between spring element 33 and flexible section 13 is able to be reduced.

In contrast to the first and second exemplary embodiments, second flange 47 completely covers the upper side of radial section 52 and the region of the transition from radial section 52 to axial section 51, i.e., it continues axially in a downward direction. Holder 41 extends axially approximately from the mid-level of master piston 9 up to and beyond the level of the enlarged end of axial section 51. Transverse bore 31 is not shown.

The fourth exemplary embodiment according to the present invention, which is shown on the right in FIG. 6, has a design that is similar to the third exemplary embodiment. Flexible section 13 is sleeve-shaped and thus has only axial section 51. In the upper region, flexible section 13 with its enlarged end is situated between second flange 47 and first flange 46, which in this exemplary embodiment have approximately the diameter of master piston 9 and in the process form first recess 42, which has the shape of a trough and annular groove. Sleeve-shaped holder 41 has two parts, the upper part enclosing the upper enlarged end of flexible section 13, and the lower part enclosing the lower enlarged end of flexible section 13, so that both parts are pressed into recesses 42, 43 in a hermetically sealing, immoveable manner, via a frictional connection. Third flange 48 is not formed, and transverse bore 31 is not shown.

The present invention is not restricted to the exemplary embodiments shown and suitable for various designs of fuel injectors 1, for instance also for fuel injectors 1 for self-igniting internal combustion engines and/or inwardly opening fuel injectors. The features of the exemplary embodiments may be combined with each other as desired.

What is claimed is:

1. A fuel injector, comprising:

a valve-closure member cooperating with a valve-seat surface to form a sealing seat;

one of a piezoelectric actuator and a magnetostrictive actuator which activates the valve-closure member;

a hydraulic coupler which includes a master piston and a slave piston, wherein a coupler volume exists between the master piston and the slave piston, and wherein the master piston and the slave piston are axially displaceable with respect to each other, and wherein the coupler volume is connected to a compensating chamber via a throttle;

a flexible section which at least partially delimits the compensating chamber; and at least one spring element which one of directly and indirectly exerts pressure on the flexible section from outside the coupler volume, via fixed components;

wherein:

the coupler volume, the throttle and the compensating chamber are filled with a hydraulic medium; and the spring element is braced on the master piston via a sleeve-shaped holder, and wherein the sleeve-shaped holder is fixed in place on the master piston in an immovable manner.

2. The fuel injector as recited in claim 1, wherein the flexible section includes: a) an axial portion that extends axially with respect to the displacement direction of the master piston and the slave piston; and b) a radial portion that extends radially with respect to the displacement direction of the master piston and the slave piston.

3. The fuel injector as recited in claim 1, wherein the flexible section has the shape of one of a perforated disk and a sleeve.

4. The fuel injector as recited in claim 2, wherein the flexible section is elastic and made of an elastomer.

5. The fuel injector as recited in claim 2, wherein the at least one spring element has a helical form.

6. The fuel injector as recited in claim 2, wherein the spring element is annular.

7. The fuel injector as recited in claim 6, wherein the spring element is open such that two ends of the spring element overlap, and wherein the two ends are rounded.

8. The fuel injector as recited in claim 6, wherein the spring element extends radially around the flexible section.

9. The fuel injector as recited in claim 6, wherein the spring element is made of steel.

10. The fuel injector as recited in claim 6, wherein the spring element exerts no pressure on the flexible section in the unloaded state of the coupler.

11. A fuel injector, comprising:

a valve-closure member cooperating with a valve-seat surface to form a sealing seat;

one of a piezoelectric actuator and a magnetostrictive actuator which activates the valve-closure member;

a hydraulic coupler which includes a master piston and a slave piston, wherein a coupler volume exists between the master piston and the slave piston, and wherein the master piston and the slave piston are axially displaceable with respect to each other, and wherein the coupler volume is connected to a compensating chamber via a throttle;

a flexible section which at least partially delimits the compensating chamber; and at least one spring element which one of directly and indirectly exerts pressure on the flexible section from outside the coupler volume, via fixed components;

wherein:

the coupler volume, the throttle and the compensating chamber are filled with a hydraulic medium;

the spring element is braced on the master piston; and the spring element acts on the flexible section via an intermediate ring.

12. The fuel injector as recited in claim 11, wherein the throttle includes a throttling ball, which is guided by a throttling gap in an opening.

13. The fuel injector as recited in claim 12, wherein the throttling ball is braced on a surface of the master piston delimiting the coupler volume.

14. The fuel injector as recited in claim 11, wherein the flexible section includes: a) an axial portion that extends axially with respect to the displacement direction of the master piston and the slave piston; and b) a radial portion that extends radially with respect to the displacement direction of the master piston and the slave piston.

15. The fuel injector as recited in claim 11, wherein the flexible section has the shape of one of a perforated disk and a sleeve.

16. A fuel injector, comprising:

a valve-closure member cooperating with a valve-seat surface to form a sealing seat;

one of a piezoelectric actuator and a magnetostrictive actuator which activates the valve-closure member;

a hydraulic coupler which includes a master piston and a slave piston, wherein a coupler volume exists between the master piston and the slave piston, and wherein the master piston and the slave piston are axially displaceable with respect to each other, and wherein the coupler volume is connected to a compensating chamber via a throttle;

a flexible section which at least partially delimits the compensating chamber; and at least one spring element which one of directly and indirectly exerts pressure on the flexible section from outside the coupler volume, via fixed components;

wherein:

the coupler volume, the throttle and the compensating chamber are filled with a hydraulic medium; and the spring element is braced on a flange which is connected to the slave piston in an immoveable manner, and wherein the flange is situated in a region of an end of the slave piston facing away from the coupler volume.

17. The fuel injector as recited in claim 16, wherein the flexible section includes: a) an axial portion that extends axially with respect to the displacement direction of the master piston and the slave piston; and b) a radial portion that extends radially with respect to the displacement direction of the master piston and the slave piston.

18. The fuel injector as recited in claim 16, wherein the flexible section has the shape of one of a perforated disk and a sleeve.

19. A fuel injector, comprising:

a valve-closure member cooperating with a valve-seat surface to form a sealing seat;

one of a piezoelectric actuator and a magnetostrictive actuator which activates the valve-closure member;

a hydraulic coupler which includes a master piston and a slave piston, wherein a coupler volume exists between the master piston and the slave piston, and wherein the master piston and the slave piston are axially displaceable with respect to each other, and wherein the coupler volume is connected to a compensating chamber via a throttle;

a flexible section which at least partially delimits the compensating chamber; and at least one spring element which one of directly and indirectly exerts pressure on the flexible section from outside the coupler volume, via fixed components;

wherein:

the coupler volume, the throttle and the compensating chamber are filled with a hydraulic medium;

the spring element acts via a sleeve ring; and the sleeve ring has the form of a disk in the radial extension and the form of a sleeve on the outside in the axial extension.

20. The fuel injector as recited in claim 19, wherein the flexible section includes: a) an axial portion that extends axially with respect to the displacement direction of the master piston and the slave piston; and b) a radial portion that extends radially with respect to the displacement direction of the master piston and the slave piston.

21. The fuel injector as recited in claim 19, wherein the flexible section has the shape of one of a perforated disk and a sleeve.

* * * * *